United States Patent [19]

Hornsby et al.

[11] Patent Number: 4,666,665

[45] Date of Patent: May 19, 1987

[54] HOT-FORGING SMALL INNER DIAMETER POWDERED METAL PARTS

[75] Inventors: William S. Hornsby, Windsor, Canada; Joseph C. Skurka, Fenton; Hayward P. Summers, Plymouth, both of Mich.

[73] Assignee: Federal-Mogul Corporation, Southfield, Mich.

[21] Appl. No.: 823,920

[22] Filed: Jan. 30, 1986

[51] Int. Cl.[4] ..... B22F 3/24

[52] U.S. Cl. ..... 419/48; 419/28; 419/50; 29/34 R; 29/DIG. 18; 72/38; 72/342; 72/352; 72/353; 72/358; 72/364; 72/375

[58] Field of Search ..... 419/28, 48, 50; 72/38, 72/364, 342, 352, 353, 358, 375; 29/DIG. 18, 34 . R

[56] References Cited

U.S. PATENT DOCUMENTS

| | | | |
|---|---|---|---|
| 2,950,816 | 8/1960 | Arenz | 207/16 |
| 3,360,975 | 1/1968 | Edgecombe | 72/272 |
| 3,364,707 | 1/1968 | Foerster | 72/38 |
| 3,455,137 | 7/1969 | Edgecombe | 72/264 |
| 3,735,648 | 5/1973 | Haller | 76/107 A |
| 3,761,257 | 9/1973 | Dunn | 75/208 R |
| 4,002,471 | 1/1977 | Sarnes et al. | 75/200 |
| 4,051,590 | 10/1977 | Halter et al. | 419/48 |
| 4,270,951 | 6/1981 | Suh et al. | 419/28 |
| 4,510,788 | 4/1985 | Ferguson et al. | 72/354 |
| 4,571,977 | 2/1986 | Veno et al. | 72/352 |

*Primary Examiner*—Stephen J. Lechert, Jr.

*Attorney, Agent, or Firm*—Robert F. Hess; Lawrence J. Shurupoff

[57] ABSTRACT

An apparatus and method of hot-forging in a forging press a cylindrical powdered metal preform to substantially full theoretical density to thereby produce a powdered metal part having a small inner bore wherein the core rod defining such bore is constructed so as to allow a continuous flow of a highly vaporizable liquid coolant such as nitrogen to the metal forming portion of the core rod and to thermally insulate the incoming coolant to assure its being maintained substantially unvaporized until being expelled to the core rod cooling chamber.

10 Claims, 6 Drawing Figures

HOT-FORGING SMALL INNER DIAMETER POWDERED METAL PARTS

BACKGROUND OF THE INVENTION

1. Field of the Invention

In general this particular invention relates to the hot-forging of metal articles to a predetermined shape. More specifically, however, the present invention relates to a novel and improved method in forging apparatus for forging metal articles having an inner bore of small diameter and the means for keeping thermally and dimensionally stable the inner core rod of the forging apparatus which forms the small bore in the metal article during hot forging.

2. Brief Description of the Prior Art

Present day forging methods and apparatus include the use of a solid core rod for forming the bore of generally concentric, cylindrical metal articles such as bushings, roller bearing race members, spur gears and the like. Typically such an apparatus will include a die for forming the axially extending external surfaces of a powdered metal part, an upper and lower punch for forming the end surfaces of such a part and the cylindrical core rod concentrically arranged and in sliding contact with one of the punches for forming the bore of the part. The die and core rod are generally stationary while the lower punch acts as a knockout mechanism at the conclusion of the forging stroke and the upper punch is mounted in a hydraulically or mechanically actuated ram and is that part of forging apparatus which moves the metal during forging stroke. The upper punch normally includes a bore which receives the uppermost portion of the core rod during the lower end of the forging stroke. Such an apparatus is shown in U.S. Pat. No. 3,761,257, assigned to the assignee of the subject invention, and it will be noted that the inner core rod is solid and no means is provided for cooling. Such an apparatus is perfectly suited for the forging of parts having a relatively large diameter inner bore in the order of four inches or more. Such a core rod is generally large enough that it will satisfactorily dissipate any heat build up at the die cavity caused during the forging stroke. Thermal stability, and consequently physical or dimensional stability of the core rod, will thus be maintained. However such a forging apparatus has heretofore been unsatisfactory for the hot-forging of parts having a bore of smaller diameter, particularly, those of 1½ inch or less. With such a small bore, the amount of heat absorbed by the proportion of the small core rod causes the core rod to become thermally and dimensionally unstable. The high temperatures cause thermal stress and thus premature failure. Likewise the increased thermal expansion of the core rod provides less control over the dimensional characteristics of the bore of the part being forged. Consequently, for the hot forging of parts having a bore diameter ranging from about four inches down to 1½ inch it has been fairly common to continously circulate a heat transfer fluid through the mandrel, in such the same way that the die itself is maintained at a stable temperature. Typically this means maintaining the heat transfer fluid at a temperature ranging from about 150° F. for the smaller bore parts to about 450° F. for the larger bore parts, circulating it through the mandrel at a rate sufficient to carry away the heat and then cooling it back down through a heat exchanger to its initial incoming temperature. Similarly it is known to cool the core rod in a manner as shown in U.S. Pat. No. 2,950,816; however such an apparatus and the technique practiced with such apparatus is considered undesirable for this particular application since it teaches the alternate circulation of water and air through the mandrel to maintain it at a preselected and rather wide temperature range of 480° F.–1100° F. Neither of these prior art techniques are considered acceptable for maintaining temperatures in the core rod when forging parts having a bore of about 1½ inches or less, particularly those of ¾ inch or less, and it is to the forging of these parts at high speed production rates of about 500 pieces per hour that the present invention is directed.

SUMMARY OF THE INVENTION

In brief, the invention is an apparatus for and method of hot-forging in a forging press a cylindrical powdered metal preform to substantially full theoretical density to thereby produce a powdered metal part having a small inner bore in an order of less than about 1½ inch diameter wherein said bore may be splined throughout at least a portion of its entire length and wherein the core rod defining such bore is constructed so as to allow a continuous flow of a vaporizable liquid coolant to the metal forming portion of the core rod and to thermally insulate the incoming coolant to assure its being maintained substantially unvaporized until being expelled to the core rod cooling chamber.

It is thus an object of this invention to hot forge in a continuous production cycle powdered metal parts having a relatively small diameter bore.

It is also an object of this invention to be able to hot forge in a continuous production cycle powdered metal parts having a relatively small diameter bore while stabilizing the temperature of the forging press core rod used to form the bore of the hot-forged part.

It is yet another object of this invention to continuously circulate through a forging press core rod a liquid coolant of a type and at a rate sufficient to cause the core rod temperature to be stabilized and the size thereof to be maintained.

BRIEF DESCRIPTION OF THE DRAWINGS

The above and other objects, features and advantages the present invention will become readily apparent upon reading the detailed description in conjunction with the accompanying drawings wherein like reference numerals indicate like structures throughout the several views.

In the drawings.

DETAILED DESCRIPTION OF THE PREFERRED EMBODIMENT

Figure 2:
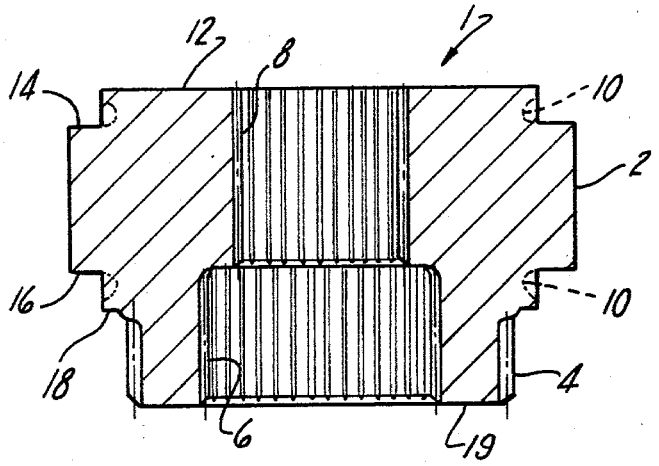
FIG. 2 is a central vertical section through the hot-forged powdered metal part shown in FIG. 1.
Figure 1:
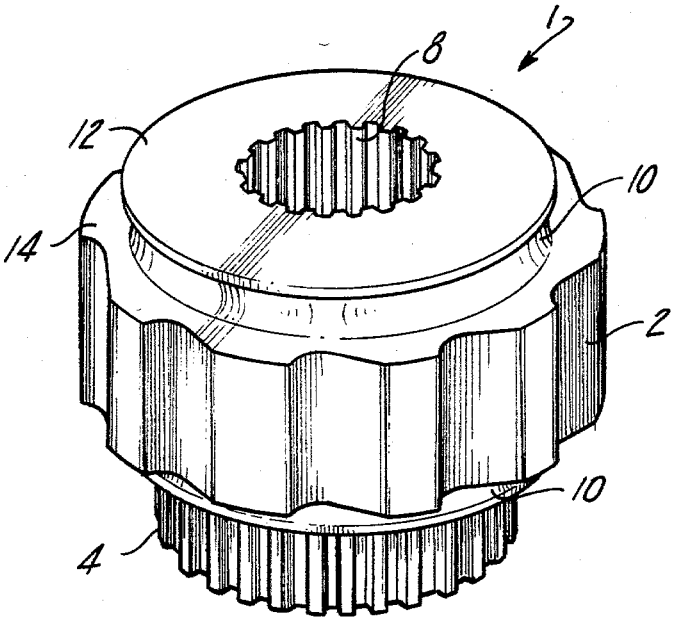
FIG. 1 is a perspective view of the hot forged powdered metal part referred to as an inner race produced in accordance with the teachings of the present invention.

Referring to the drawings in detail, FIGS. 1 and 2 show a hot-forged powdered metal part 1 of intricate design. The particular part shown is the principal component of an automatic light duty vehicle, automatic transmission, torque converter lockup mechanism. The advantage of the present process is that many of these intricate design features can be and are hot-forged to finish dimension and require no further machining or finishing. The principal as-forged design features include the external O.D. cam surface 2, the external spline 4 and the two internal splines 6 and 8. The principal machining required subsequent to forging is the two annular grooves 10 shown in dotted line FIG. 2 and the various end faces 12, 14, 16, 18 and 19.

The finished powdered metal part shown in FIGS. 1 and 2 has the following physical and metallurgical characteristics as shown in Table I below.

TABLE I

Material: H 4662 powdered metal
Density: 7.82 g/cc (grams per cubic centimeter minimum)
Heat Treatment: Oil quenched, then stress relieved at 148.8° C. minimum for one hour minimum
Hardness: Rc 58 minimum
Pitch diameter - Internal Spline 8: 18.0000 cm
Pitch diameter - Internal Spline 6: 25.5000 cm
Pitch diameter - External Spline 4: 41.4480 cm
Cam Surface 2 Diameter: 56.7940 cm (maximum)
Overall Length: 35.43 cm It will be noted the internally splined portion 8 of the bore is 18 centimeters in pitch diameter or approximately 0.70 inches; this results in a spline base diameter of approximately 0.50 inches and consequently a core rod of unusually small diameter.

Figure 3:
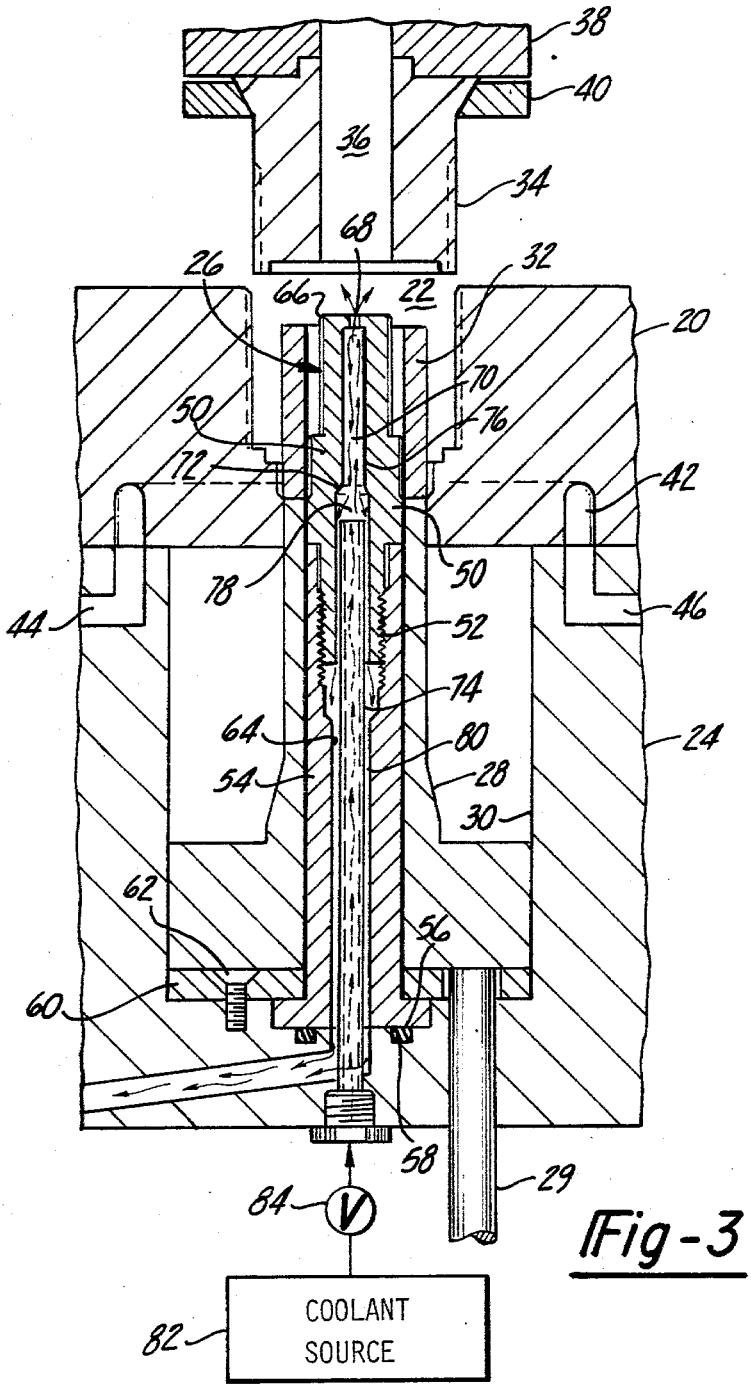
FIG. 3 is a central vertical section through a hot-forging or extrusion press showing the hot-forging die at the start of a hot-forging or extrusion operation in accordance with the present invention.

In FIG. 3 there is shown the details of the forging apparatus including the usual, fairly conventional, portions of any hot-forging apparatus, namely: the die 20 having a die cavity 22 formed therein, a lower die shoe 24, a core rod assembly generally designated as 26, a lower punch 28 concentrically received about said core rod assembly and adapted to reciprocate with respect to the core rod assembly within a cylinder 30. The die 20, lower punch 28 and core rod assembly 26 all constitute or form portions of the die cavity 22. The reciprocal lower punch 28 is adapted to be actuated at the end of the forging step by a mechanically actuated ejector pin 29 which is slidably received within the lower die shoe 24. A cylindrically shaped, powdered metal preform 32 is received within the die cavity. Upper punch 34 completes the die cavity and thus the formation of the part when it is brought down into contact with the powdered metal preform during the hot-forging stroke. The upper punch includes a bore 36 which is slidably received in very close tolerance within the uppermost portion of core rod assembly 26. The upper punch is fixedly maintained within an upper punch riser and forging press ram 38 as partially shown by means of a conventional retention ring 40 bolted thereto.

Means are provided for maintaining the die 20 at a constant temperature. This includes an annular cooling chamber 42 within the die 20 which communicates with an inlet passage 44 and outlet passage 46, each formed within lower die shoe 24. Suitable means (not shown) is provided to continuously circulate a conventional heat transfer fluid through the die so as to maintain it at a fairly constant temperature. It is desirable that the heat transfer be selected such that its characteristics allow it to be maintained at a temperature of approximately 500° F.

It will be appreciated that the die and particularly that portion of the die forming the die cavity 22 has been shown somewhat schematically. It is not uncommon to form such a die out of multiple die components, thus facilitating the machining of the die configuration including various steps and shoulders. Such an arrangement is shown for example in U.S. Pat. No. 3,735,648 and is not considered a part of this invention. This invention does include a uniquely constructed core rod assembly and the means for conducting a vaporizable liquid coolant through said core rod assembly. Referring again to FIGS. 3 and 4, it will be seen that the core rod assembly 26 includes a cylindrical core rod 50 threadedly connected as shown at 52 to a core rod riser 54. The core rod riser is flanged at its lower end and sits upon an O-ring 56 fitted within a groove 58 for sealing the mutually abutting surfaces against the escaped coolant, as will be described later. The core rod riser is fixed to the lower die shoe by means of a lower punch spacer 60 in the form of an annular ring having a series of machine screws 62 connecting it to the lower die shoe. The core rod riser 54 and core rod 50 are hollow and include an axial bore 64 extending throughout their entire length to the tip 66 of the core rod, which includes a control vent 68 connecting cooling chamber 70 formed by the bore 64 within the core rod with the atmosphere outside the die cavity, for purposes to be explained later. The core rod cooling chamber 70 includes a step formed by an annular shoulder 72 so as to permit ingress of a coolant tube 74 and accurate sizing of the portion of the cooling chamber which is exposed to the highest thermal stresses during the forging operation, such portion being the smaller diameter portion shown generally at 76. It will be noted that the coolant tube 74 extends into the large diameter portion of the bore 64 within the core rod but stops short of the shoulder 72 a sufficient distance so as to define an entry chamber 78. It is desirable that this entry chamber be of sufficient volume to allow the pressure of vaporized or partially vaporized cooling fluid to be maintained at a minimum; the control vent 68 is provided and sized for this same purpose. The control vent 68 is sized (i) small enough to preclude cooling fluid from being vented to the atmosphere as a liquid and (ii) large enough to prevent gas pressure build up within the cooling chamber 70 such that there would be precluded a sufficient and steady flow of cooling fluid to the cooling chamber 70. It will be recognized also that there will always be sufficient pressure within the coolant return passage 80 to preclude air entering the cooling system. Any pressure above atmospheric pressure will suffice. This combination or cooling chamber technique thus allows that the cooling chamber will be provided with a continuous, uninterrupted flow of cooling liquid for vaporization, and thus maximum cooling effect, within the cooling chamber. Towards this same purpose the bore 64 is sized relative to the cooling tube 74 such that the coolant return passage 80 and the returning vaporized gas will maintain the entry cooling liquid at a temperature below vaporization until it reaches or nearly reaches chamber 78. Ideally, the cooling system (bore 64, tube 74, chambers 70 and 78, and vent 68) is sized such that the cooling fluid is only partially vaporized within cooling chamber 70 and a minor liquid portion will be returned through passage 80 to about the threaded or lower end of core rod 50 before the heat within the core rod causes it to vaporize. Such a technique will provide maximum effect in maintaining the incoming coolant in a liquid state prior to exiting tube 74 at entry chamber 78.

The liquid coolant is supplied to the core rod cooling chamber 70 from a suitable pressurized coolant source 82 through a flow control valve 84. A preferred liquid coolant is nitrogen which has a vaporization temperature of minus 320° F. As such, it produces its own pressure within the source or tank 82, thus requiring only the means or valve 84 to regulate the flow. Once the used coolant is expelled through passage 80 it can be vented to atmosphere or used elsewhere in the forging process as an inert gas source.

Using the above-described technique it is made possible to maintain the core rod at a fairly stable temperature of about 500° F. throughout continuous production.

While the remainder of the process for forming the hot-forged powdered metal part is not considered a part of this invention nor the details of the forged press operation other than cooling of the core rod assembly, reference is made to U.S. Pat. No. 4,002,471, assigned to the assignee of the present invention, incorporated herein by reference, for appropriate operating and process parameters including that of immediately quenching part 1 in oil following forging so as to obtain a through hardened part having an Rc 58 hardness.

Figure 4:
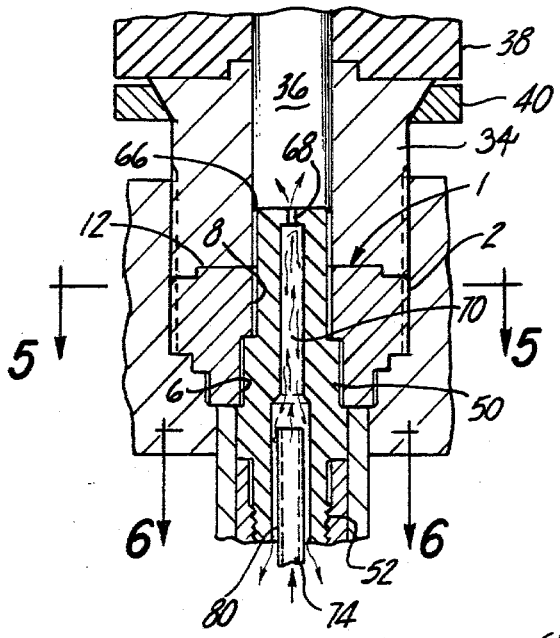
FIG. 4 is a central vertical section through the same hot-forging or extrusion press shown in FIG. 3 but at the conclusion of the hot-forging or extrusion operation.

FIG. 4 shows the forging apparatus at the bottom of the forging step wherein upper punch 34 is at the bottom of its stroke within die cavity 22. It will be noted that the vaporized liquid coolant passes as gas through vent 68 in the tip of the core rod 50 and passes through bore 36 of the upper punch to the atmosphere. Gas will continue to be expelled through the vent hole to the atmosphere during a return stroke of the upper punch.

Figure 5:
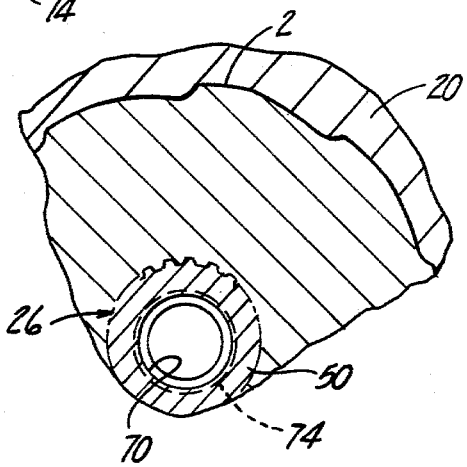
FIG. 5 is a sectional view taken along the lines 5—5 of FIG. 4.

FIG. 4 also shows, as does FIG. 5, the detail of the die components configured so as to form the intricate shape on the part being forged. Particularly it will be noted that upper punch 34 and the inner wall or bore of die 20 which forms die cavity 22 are in close interengaging sliding contact along their entire respective circumferences and that the upper punch includes on its outer circumference the cam surface 2 and that the die cavity includes the inverse image of such cam shape. Likewise it is preferred that the bore 36 of the upper punch be splined so as to be in interfitting engagement with the splines 8 formed on the core rod 26. The provision of splines on the bore of the upper punch as explained above is not required, however the interengaging configuration of the upper punch with the core rod precludes the escape of extruded metal along the radial surfaces of the upper punch bore and thus eliminates flash and thereby the need to remove it.

Figure 6:
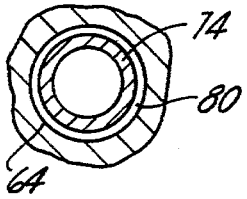
FIG. 6 is a sectional view taken along the lines 6—6 of FIG. 4.

FIG. 6 shows clearly the concentric and centered relationship of the coolant tube 74 to the bore 64 of the core rod riser.

Obviously, numerous modifications and variations of the present invention are possible in light of the above teachings. It is therefore to be understood that within the scope of the appended claims, the invention may be practiced otherwise than as specifically described herein.

What is claimed is:

1. Apparatus for hot-forging to substantially full theoretical density a cylindrical powdered metal preform to thereby produce a powdered metal part having a small inner bore in an order of less than about 1.50 inch diameter and wherein said bore may be splined throughout at least a portion of its entire length comprising, a first punch having a first bore extending inwardly from an end thereof, a die concentric with said first punch and having a die cavity adapted to receive said first punch, the radially outer wall of said die cavity having a first configuration formed thereon, a core rod assembly centered within and extending for substantially the full length of said die cavity into said die cavity from one end thereof opposite said first punch, a second punch concentric with said core rod assembly and in sliding contact with said core rod assembly, said second punch in conjunction with said core rod assembly closing said one end of said die cavity, fluid circulating means for controlling the temperature of said die by passing a thermally conducting fluid through select portions of said die, and coolant means for (i) passing a vaporizable liquid coolant concentrically through said core rod assembly to the tip thereof within said die cavity, (ii) causing said vaporizable liquid to at least partially vaporize, (iii) causing a portion of said vapaorized gas to be expelled to the atmosphere, and (iv) causing the remainder of said gas and said vaporizable liquid, if any, to be returned through said core rod assembly.

2. The apparatus of claim 1 wherein:

said core rod assembly includes a core rod having a hollow cylindrical cooling chamber extending along its entire axial length from one end thereof to said tip, and a control vent located at said tip for venting a portion of said vaporizable gas to the atmosphere.

3. The apparatus of claim 2 wherein:

said core rod assembly further includes a cylindrical core rod riser threadedly connected to said core rod and having an axially extending bore in communication with said cooling chamber and constituting a coolant return passage, said coolant means including a coolant tube of less diameter than that of said coolant return passage and extending from the exterior of said apparatus whereby the incoming vaporizable liquid coolant may be passed through said coolant tube and is thermally insulated from the higher temperatures of the core rod assembly by means of the vaporized cooling fluid being expelled from said cooling chamber through said coolant passage.

4. The apparatus of claim 3 further including an ejector pin in abutting engagement with said second punch and adapted to cause said second punch to slide along the length of said core rod assembly and eject the finished forged part from said die cavity at the conclusion of the forging stroke of the apparatus.

5. The appartus of claim 3 wherein on the forging stroke of the apparatus said first bore of the first punch receives in sliding contact a substantial portion of said core rod including said tip.

6. The apparatus of claim 3 wherein:

said first punch is the upper punch of a vertically orientated forging apparatus and the second punch is the lower punch of the forging apparatus.

7. A method of hot-forging in a forging press to substantially full theoretical density a cylindrical powdered metal preform to thereby produce a powdered metal part, said part having a small inner bore in an order of less than about 1.50 inch diameter and said forging press including: (i) a first first punch having a first bore extending inwardly from an end thereof; (ii) a die concentric with said first punch and having a die cavity adapted to receive said first punch, the radially outer wall of said die cavity having a first configuration formed thereon; (iii) a core rod assembly centered within and extending into said die cavity from one end thereof opposite said first punch for substantially the full length of said die cavity; and (iv) a second punch concentric with said core rod assembly and in sliding contact with said core rod assembly, said second punch in conjuction with said core rod assembly closing said one end of said die cavity, said method comprising the steps of:

circulating a vaporizable liquid coolant from a coolant source through said core rod assembly, said coolant being supplied to said core rod assembly at a rate sufficient to maintain said core rod at an average temperature of about 500° F. throughout a continuous series of forging cycles and at a rate which will cause at least the major portion of said coolant to vaporize, venting a minor portion of said vaporized coolant to the atmosphere at said die cavity, and returning the remainder of said vaporized coolant and any liquid coolant through said core rod assembly.

8. The method of claim 7 wherein:

the remainder of said vaporized coolant and any liquid coolant while being returned through said core rod assembly insulates the incoming cooling fluid from the heat of said core rod assembly and said second punch and thereby precludes premature vaporization of the incoming cooling fluid.

9. The method of claim 8 wherein:

said liquid coolant is nitrogen, said liquid coolant being maintained at a constant temperature of minus 320° F. within said coolant source.

10. The method of claim 9 wherein:

said coolant is caused to delivered from said coolant source and returned to atmosphere through the same passageway within said core rod assembly.

* * * * *